United States Patent [19]

Ahl

[11] 4,029,286

[45] June 14, 1977

[54] APPARATUS FOR THE CONSTRUCTION OF CEILING IN MULTI-STORY CONCRETE BUILDINGS

[76] Inventor: Bernard Ahl, Bonner Wall 37, 5 Cologne 1, Germany

[22] Filed: Apr. 16, 1973

[21] Appl. No.: 351,435

[30] Foreign Application Priority Data

Nov. 16, 1972 Germany ..... 2256262

[52] U.S. Cl. ..... 249/19; 264/33

[51] Int. Cl.[2] ..... E04G 11/20; E04G 11/38

[58] Field of Search ..... 264/33–35; 249/20–22, 19; 425/63, 65

[56] References Cited

UNITED STATES PATENTS

| | | | |
|---|---|---|---|
| 1,130,084 | 4/1916 | Staehle | 264/34 |
| 1,279,472 | 9/1918 | Springer | 264/34 |
| 1,701,113 | 2/1929 | Keller | 264/33 |
| 2,297,952 | 10/1942 | Friberg | 249/24 |
| 3,275,719 | 9/1966 | Dudson | 425/63 |
| 3,420,981 | 1/1969 | Martinet | 249/78 |
| 3,578,732 | 5/1971 | Lount et al. | 264/35 |

FOREIGN PATENTS OR APPLICATIONS

| | | | |
|---|---|---|---|
| 108,249 | 8/1939 | Australia | 264/33 |
| 167,316 | 12/1950 | Austria | 249/20 |
| 941,703 | 1/1949 | France | 264/33 |

OTHER PUBLICATIONS

Engineering News–Record, Oct. 16, 1947 p. 72.

*Primary Examiner*—Richard B. Lazarus
*Assistant Examiner*—John McQuade
*Attorney, Agent, or Firm*—Diller, Brown, Ramik & Wight

[57] ABSTRACT

This disclosure relates to a novel apparatus for constructing ceilings in multi-story concrete buildings by first forming the vertical walls of the building to a desired height, and thereafter forming the ceilings in sequence from top-to-bottom. The apparatus preferably includes a panel-like support within the peripheral walls of the building suspended from the building top by cables operated through power winches for raising and lowering the panel-like support incident to performing a building operation.

4 Claims, 8 Drawing Figures

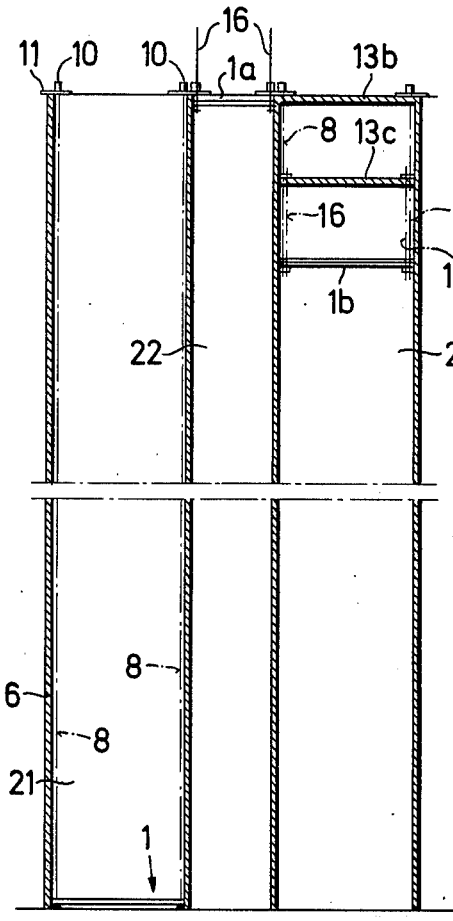
FIG. 2
FIG. 3
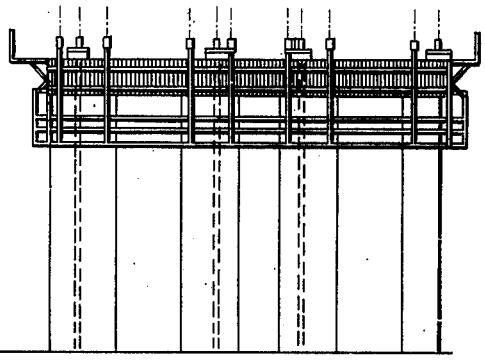
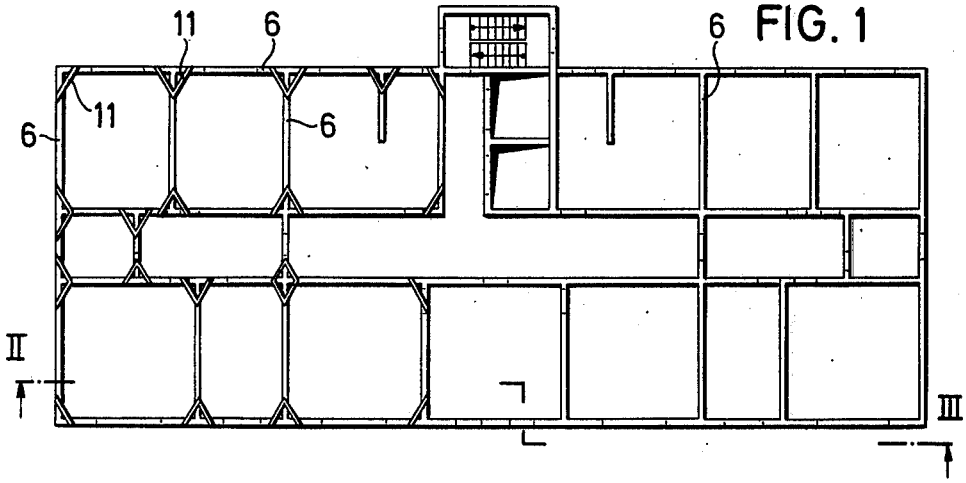
FIG. 1

FIG. 4
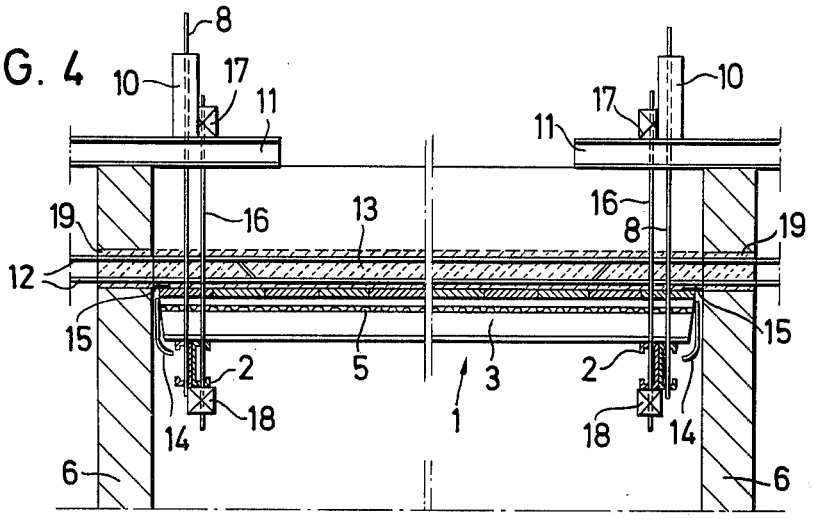
FIG. 5
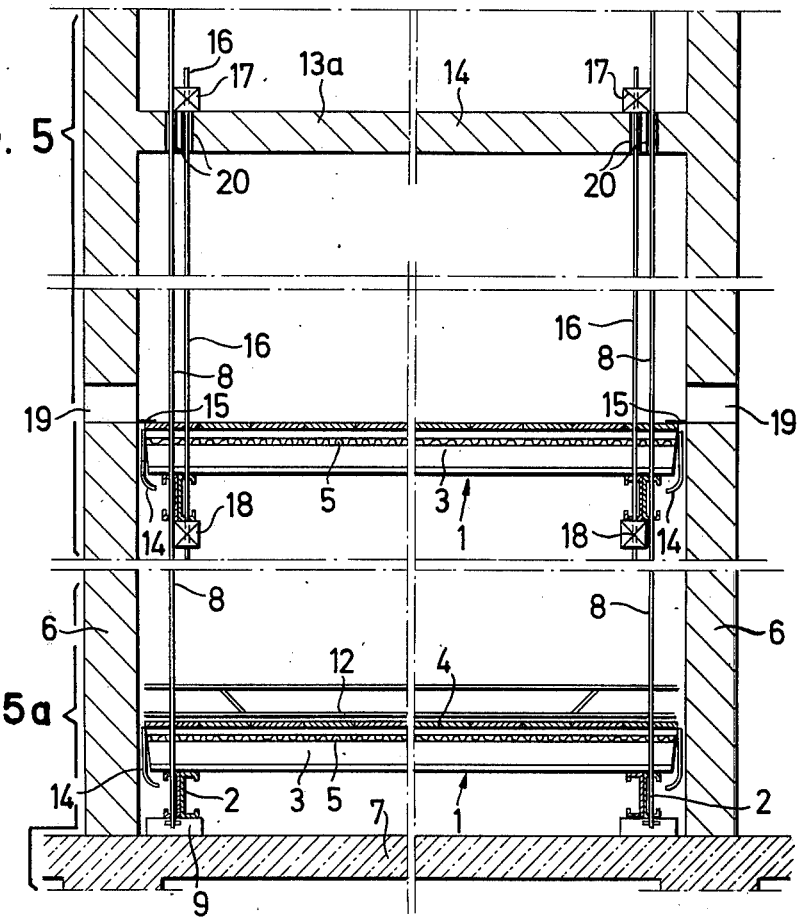
FIG. 5a

APPARATUS FOR THE CONSTRUCTION OF CEILING IN MULTI-STORY CONCRETE BUILDINGS

This invention relates to a novel apparatus for constructing ceilings during the construction of a multi-story concrete building after the completion of the vertical, peripheral or room forming walls which are preferably but not necessarily constructed by known concrete slidemolding systems.

In order to reduce building time and therefore save costs it is known to build the entire outer inner walls of multi-story buildings by the slide-molding system although but one story can be built per day and though this is advantageous it is appreciably reduced when one attempts to thereafter incorporate concrete ceilings in the structure. Ceilings in such buildings are constructed as follows:

The platforms or molds upon which the concrete is to be laid are positoned, propped up, and otherwise shored at a height to achieve desired ceiling height once the concrete for the top platform has set. Reinforcement is generally employed and after the setting of the ceiling of the first story the molds or platforms, the shoring, etc. is removed and delivered to the next story folowed by the performance of the cycle just described which is repeated during each cycle for the production of ceilings from building bottom to building top.

Another possible way of finishing a building which simply has peripheral walls is to employ prestressed concrete ceiling strips, generally of rather large widths, and install the same from building bottom successively to building top generally employing heavy and costly crane installations along complicated and expensive brackets for the support of the ceilings.

From the foregoing a primary object of this invention is to substantially facilitate the subsequent assembly of ceilings (or floors) in concrete buildings which are initially formed having only their peripheral or room walls. In accordance with the preferred method a platform supports thereon at a desired height flowable and settable material (concrete). After having set the platform is lowered for subsequent molding operations. In this manner the ceiling platform or mold is lowered by stories from the top and this avoides cumbersome shoring, propping, removing and reapplying in an upward direction, as is conventional practice.

In accordance with the present method the mold or platform can be used many times without disassembly and reassembly particularly if the room walls are of generally constant configurations so that the platform need not be altered as it is descended after each molding operation.

The platform or mold is preferably assembled on the foundation of the building within a particular area defined by peripheral or room walls. Thereafter the entire platform is raised to the height of the roof or uppermost ceiling and molding takes place from building top to building bottom with the platform being maintained stationary at each height for a sufficient time for the concrete or similar flowable material to set or solidify. At the termination of a construction operation the platform is at a lower level, generally ground floor or basement, and therefore the same may be readily removed.

In addition to supporting the platform by suspension cables which can be readily adjusted the system also utilizes anchoring means in the form of vertically disposed steel bars which are slightly greater in height than the vertical distance between adjacent ceilings. At one end the bars are coupled to the platform while opposite ends pass through bores or openings of the previously formed next upper ceiling and are suitably anchored thereto. Preferably both the suspension cables and locking bars are at the corners of the rooms to achieve ease of mobility for subsequent workers.

In order to facilitate the vertical displacement of the platforms within the peripheral walls of the building they may be provided with guide elements, such as spring steel cross bands or the like which are preferably rounded and hence preclude the platform from sticking during its motion and in effect make the same self-centering. Also since flowably material, such as concrete, is deposited atop the platform the latter preferably is provided with a seal about its periphery to make leakage of the flowable material minimal between the time the material is poured and the setting thereof.

It is also possible in keeping with this invention to provide the platforms with heating equipment incorporated therein, e.g., an electric coil heater, so that the freshly applied concrete can be heated for quicker setting. As a consequence thereof the platforms or molds may be used one day after the other or at least every three days for the production of successive ceilings (or floors).

If the suspension cables are moved by winches, conventional means are provided for assuring that they work in perfect parallelism in order that the platform moves normal to the vertical as it is raised to its initial position and during subsequent lowering during molding operations.

With the above and other objects in view that will hereinafter appear, the nature of the invention will be more clearly understood by reference to the following detailed description, the appended claimed subject matter, and the several views illustrated in the accompanying drawings.

IN THE DRAWINGS

FIG. 1 is a top plan view of a multi-story building which is to constructed in accordance with the conventional slide molding system, and illustrates the left portion thereof being finished and the right portion being on the verge of being finished with the walls thereof being concreted in the slide moldings.

FIGS. 2 and 3 are sectional and side views respectively taken generally along the line II – III of FIG. 1 with FIG. 2 showing the production of ceilings in keeping with the present method of this invention.

FIGS. 4, 5 and 5a are vertical sections through a portion of the building showing several levels with FIG. 4 illustrating the manner in which the uppermost ceiling or roof is fabricated while FIG. 5 illustrates the mold or platform being shown at ground level and FIG. 5 illustrates a second position with the mold or platform being suspended from an earlier formed ceiling.

Figure 6:
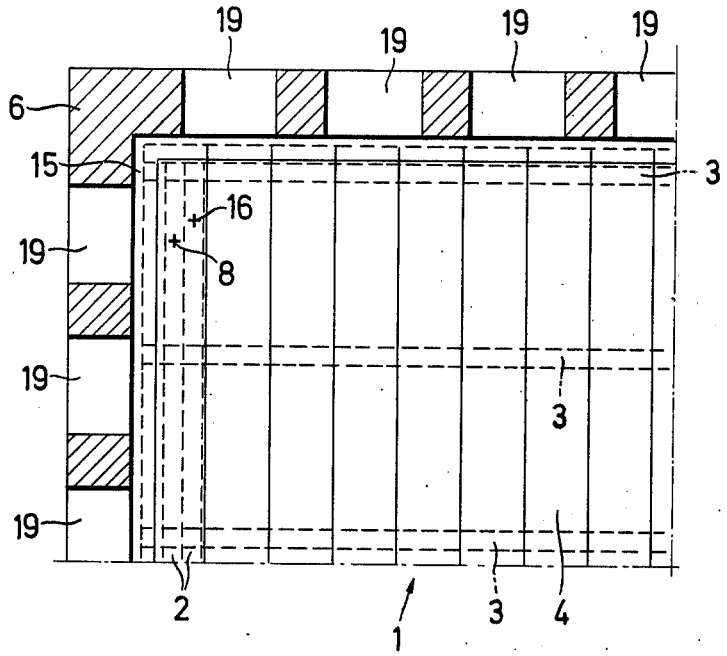
FIG. 6 is a top plan view illustrating horizontal openings in the room or peripheral walls for the reception of reinforcing beams, rods or the like and portions of the concrete or similar flowably but settable material.

A novel ceiling mold apparatus 1 is a self-supporting panel-like body, mold or platform which is defined by a plurality of spaced transverse beams 2 and longitudinal beams 3 thereupon. Mold panels or platforms 4 are placed on the longitudinal beams and secured thereto in a conventional manner. A heater 5, if desired or found necessary, may be provided directly below the platform 4 to accelerate the setting of the concrete or like flowable but settable material. Preferably the entire system 1 is prepared as a room unit or, stated otherwise, of a size as viewed in plan (FIG. 6) which corresponds to the inner dimensions and configuration of the room as defined by the vertical walls 6 rising from the foundation 7 (FIG. 5*a*).

Figure 7:
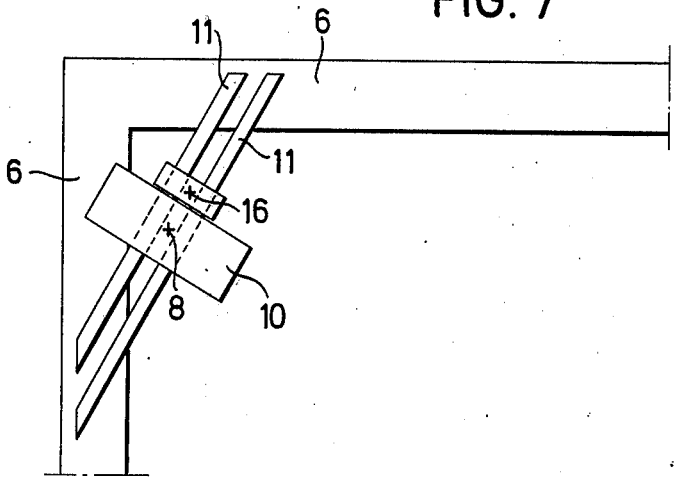
FIG. 7 is a top plan view of a support deck at a corner at the top of the building and illustrates means for lifting, lowering and locking the mold or platform.

The platform or mold 1 has attached thereto wire ropes or cables 8 which are advantageously disposed at each of the room corners. To this effect the cables 8 may be secured with their lower ends to blocks 9 (shown only in FIG. 5*a*) engaging below the beams 2 whereas at the building top they are connected with conventional means 10, such as winches or the like, through which the platform 1 may be raised or lowered selectively. The devices 10 are advantageously operated hydraulically and include conventional systems to make certain that the cables 8 operate in unison so that the platform 1 ascends or descends normal to the vertical. Preferably the devices 10 are supported atop beams or decks 11 (FIG. 7) at each corner of the room.

After being initially assembled at the lowermost or foundation level 7 (FIG. 5*a*) the platforms 1 are raised through the mechanisms 10 as the cables 8 are drawn upwardly. In order to insure perfect guidance of the platforms 1 along the peripheral outer concrete walls 6 the platforms 1 carry slide elements which are preferably spring steel bands 14. Additionally, since concrete is to poured atop the panels 4 of the platform 1, as shown in FIG. 4, sealing strips 15 are provided about the periphery of the platform 1 in order to assure that leakage between the walls 6 and the platform 1 is maintained minimal or precluded. Once in the uppermost position (FIG. 4) the platform 1 is firmly anchored by means of steel bars 16, once again at the corners of the walls 6. At upper and lower ends (unnumbered) thereof the steel bars 16 are provided with anchoring or locking devices 17, 18 which may be adjustably secured heightwise to the steel bars 16. Thus by adjusting the anchoring devices 17, 18 relative to the bars 16 the platform 1 can be held exactly at the required height.

In order to make a reinforced concrete ceiling, reinforcing bars 12 span the platform 1 with the ends received in opposite apertures 19, as is most apparent from FIG. 4. The openings 19 are conventionally then closed at the exterior of the wall 6 in order that concrete poured atop the platform 1 will simply not run out the openings 19 and down the exterior walls 6 of the building. Once the concrete has set and the ceiling 13 is rigidified the lock or anchoring devices 17 are released and the platform 1 is lowered by the mechanisms 10 through the cables 8. Suitable means (not shown) are provided for assuring that the rods 16 do not simply fall downwardly upon the release of the anchoring devices 17. Thus the bars 16 are lowered automatically with the platform and to assist in such operation the bars 16 and cables 8 may pass through cylindrical sleeves which are positioned thereabout prior to the pouring of the concrete to form the ceiling 13. Thus the floor 13 when it solidifies will have bores, corresponding to the bores 20 of the ceiling 13*a*, and such will permit the platform 1 to be readily descended as the cables 8 and bars 16 move downwardly without interference. At a desired height the steel bars 16 are again anchored to the last formed ceiling, as the ceiling 13a, to permit the next ceiling to be formed upon the platform 1 and supported by the last-formed and next in height ceiling.

Reference is now made to FIG. 2 which illustrates the platform 1 at the bottom of a vertical room unit 21 with the cables 8 connected to the hydraulic lifting devices 10 atop the decks 11. Thus the platform 1 in room unit 21 illustrates the initial position of the platform 1 prior to be lifted to its uppermost position, as shown at 1a in room unit 22. In room unit 23 there is illustrated an intermediate phase in which two uppermost ceilings 13*b* and 13*c* have been completed and the platform 1b is at its next lower height and is supported by the cables 8 and the bars 16 from the ceiling 13*c*.

Thus beginning with a building having only peripheral or room walls the platform 1 is assembled on the lower finished concrete ceiling which is the foundation 7 of FIG. 5 and is the position of the platform 1 in room unit 21. The support decks 11, the mechansims 10 and the remaining apparatus earlier described are connected with the cables 8 and rods 16 preferably being supported at the corners of the rooms, as indicated best in FIG. 6. By means of connecting the hydraulically actuated devices 10 in parallel it is possible to raise not simply one of the platforms but, if desired, several platforms of different room units at the same time. Thereafter progressive formation of ceilings from top to bottom as at 13*b*, 13*c* (FIG. 2) and 13, 13*a* etc. (FIGS. 4 and 5) may take place in the manner earlier fully described.

It is also possible in keeping with this invention to first stress each ceiling upwardly by a tightening of the cables 8 to permit the anchoring devices 17 to be more readily released after which the cables 8 are lowered to the next lowest position. In this manner each ceiling is finished in its operational sequence in the absence of newly prepared platforms, molds, mountings, reinforcements, etc. and in the absence of continuous ad repetitious assembliy and disassembly.

While preferred forms and arrangement of parts have been shown in illustrating the invention, it is to be clearly understood that various changes in details and arrangement of parts may be made without departing from the scope and spirit of the disclosure.

I claim:

1. Apparatus for constructing ceilings during the construction of a multi-story building after the completion of peripheral walls of the building comprising means for installing ceilings sequentially from building top to building bottom, said ceiling installing means including platform means for receiving thereon flowable and settable material, means for supporting the platform means until the flowable material has set, means for lowering the platform means to be a next lower position for subsequent molding operations, means for anchoring said platform means during the setting of the flowable material, said anchoring means are rigid bars, first means for coupling said bars to said platform means, second means for coupling said bars to a next uppermost earlier formed ceiling, said supporting means are flexible cables, third means for coupling an end of each cable to said platform means, and said bars and cables being disposed one each as an immediately adjacent pair at spaced points of said platform means whereby said platform means in the area of each pair of a bar and cable is jointly suspendingly supported thereby.

2. The apparatus as defined in claim 1 wherein each pair of bar and cable is positioned at an associated corner of said platform means.

3. The apparatus as defined in claim 1 wherein at least one of said first and second coupling means are selectively adjustable along the length of its associated bar to thereby provide selective adjustment of said platform means at areas thereof adjacent said spaced points to level said platform means and/or vary, if desired, the height between sequentially installed ceilings.

4. The apparatus as defined in claim 2 wherein at least one of said first and second couping means are selectively adjustable along the length of its associated bar to thereby provide selective adjustment of said platform means at areas thereof adjacent said spaced points to level said platform means and/or vary, if desired, the height between sequentially installed ceilings.

* * * * *